US005337639A

United States Patent [19]

Morrison

[11] Patent Number: 5,337,639

[45] Date of Patent: Aug. 16, 1994

[54] OUTFEED LIFTER RAMP FOR BLANKING BOXES AND OTHER DIE-CUT PAPER PRODUCTS

[75] Inventor: Richard E. Morrison, Amherst, N.Y.

[73] Assignee: Die-X Tooling Systems, Amherst, N.Y.

[21] Appl. No.: 899,427

[22] Filed: Jun. 16, 1992

[51] Int. Cl.[5] ..... B26D 7/18

[52] U.S. Cl. ..... 83/111; 83/162; 83/440; 83/440.1; 83/690; 493/83

[58] Field of Search ..... 83/112, 145, 405, 443, 83/105, 162, 684, 685, 690, 111, 440, 440.1; 493/82, 83, 342, 373

[56] References Cited

U.S. PATENT DOCUMENTS

| | | | |
|---|---|---|---|
| 346,165 | 7/1886 | Kingsbury | 493/61 |
| 375,354 | 12/1887 | Hodgson | 83/685 |
| 550,731 | 12/1895 | Talcott | 83/145 |
| 1,501,072 | 7/1924 | Stanbon | 83/405 X |
| 3,148,572 | 9/1964 | Lindholm | 83/145 |
| 3,249,272 | 5/1966 | Scarpa | 493/373 X |
| 3,946,627 | 3/1976 | Hofmann | 493/342 X |
| 4,452,595 | 6/1984 | Huff | 493/373 X |
| 4,921,154 | 5/1990 | Abe et al. | 83/690 X |
| 5,179,882 | 1/1993 | Takeuchi et al. | 493/342 X |

FOREIGN PATENT DOCUMENTS

| | | | |
|---|---|---|---|
| 448699 | 5/1948 | Canada | 83/684 |

*Primary Examiner*—Rinaldi I. Rada
*Assistant Examiner*—Clark F. Dexter
*Attorney, Agent, or Firm*—Sommer, Oliverio & Sommer

[57] ABSTRACT

The present invention contemplates an outfeed lift ramp (24) for use with a male (19) and female (18) combination of blanking dies for separating a diecut paper box blank (21) from an attendant web portion (20). Outfeed lift ramp (24) is appended to the leading edge (33) of female die member (18) adjacent to blanking through holes (32) at preselected points corresponding to a series of naturally occurring or benign box blank slots (31). During the blanking operation, the diecut and partially stripped sheet (17) is interposed over the die through holes and the upper arcuate portion of the lift ramp (38) extends through the through slots (31) of the sheet to be blanked thereby permitting the sheet to lie flush against the female die surface. After blanking, box blanks 21 are forced through female die through holes (32) and all that remains on the female die surface is a flexible and flimsy web (20). Upon automatic removal of the web across the die face, entanglement and snagging on the die leading edge (33) often occurs. The lift ramps (24), however, while not impeding the blanking operation, serve to lift and support the flexible internal webs (25) generated by blanking across the die leading edge independent of the non-supportive nature of the web (20).

1 Claim, 4 Drawing Sheets

Fig. 5.
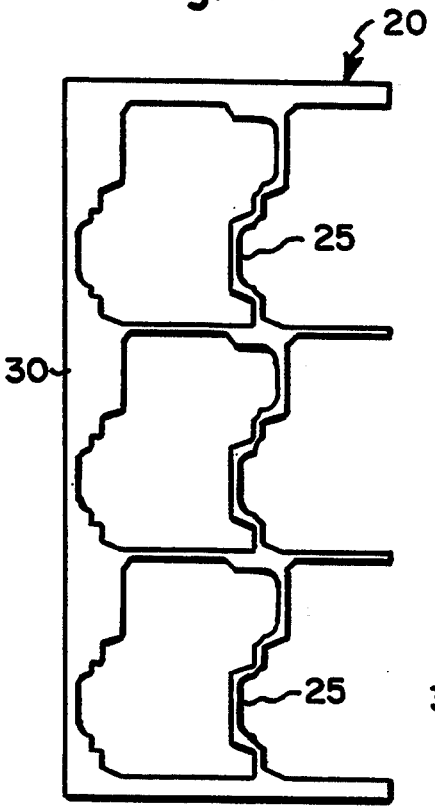
Fig. 6.
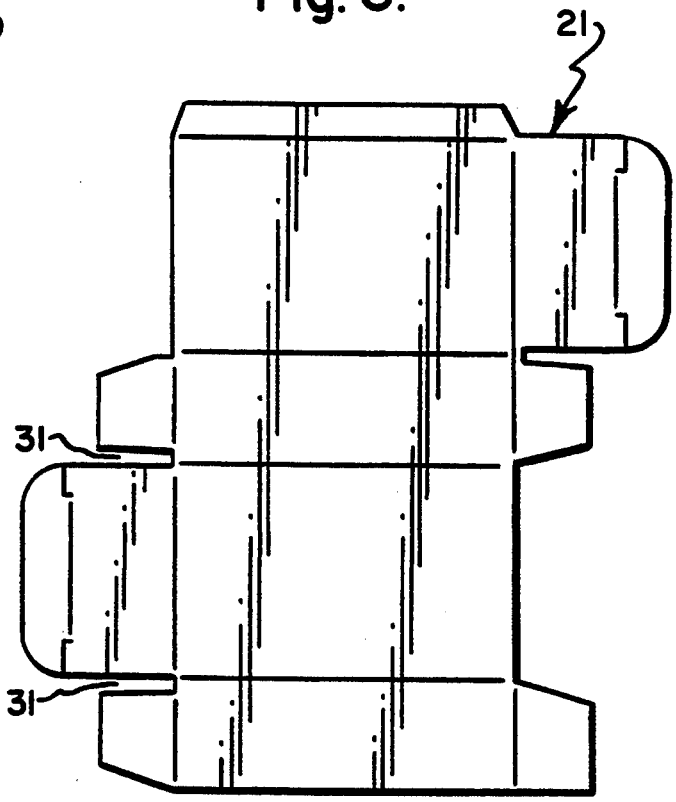
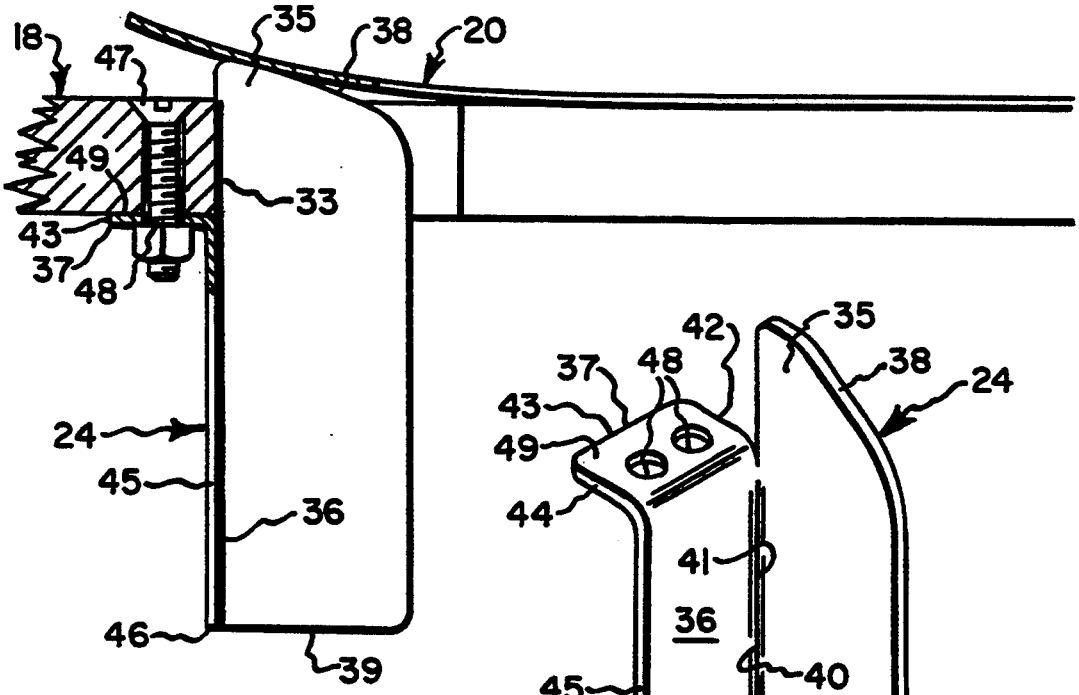
Fig. 8.
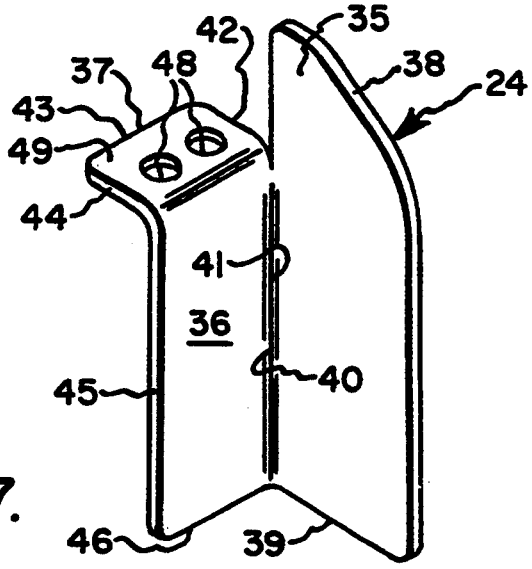
Fig. 7.

OUTFEED LIFTER RAMP FOR BLANKING BOXES AND OTHER DIE-CUT PAPER PRODUCTS

TECHNICAL FIELD

The present invention relates generally to the automated die cutting of blanks and more specifically, to an improved apparatus for the automatic die cutting of blanks primarily for formable paper containers, product display cards or other die cut paper products.

BACKGROUND OF THE INVENTION

Cardboard or paper containers or boxes of various shapes and sizes are commonly used to contain consumer products, foods, cosmetics and other merchandise. Such boxes and containers are bio-degradable, easily disposed of and may be manufactured in accord with practically any specification relatively inexpensively.

Over the years, computerized technology has evolved wherein the process of generating boxes or die cut forms from sheets of paper or cardboard stock is done automatically by controlled machine systems without the need for intensive labor or human operators. It is also common for the manufactured planar box blanks to be assembled, filled with merchandise and sealed automatically by machine.

Too, the advent of computer and CAD technology now enables designers to compile optimum layouts of a plurality of die cut forms on a single sheet for multiple scoring and stamping during the course of the manufacturing process. In addition, computer technology, combined with attendant laser technology, has enabled box manufacturers to utilize highly accurate cutting and creasing dies for producing a planar sheet of diecut blanks and also, to produce male and female blanking dies used to automatically separate the die cut or stamped forms from the intervening web or waste portion of the sheet. Automatic blanking, in particular, results in a tremendous cost savings compared to the identical operation when performed by laborers using manual blanking means.

The current technology and the known prior art includes automatic systems or presses that feed large sheets of paper for cutting and creasing of blanks and also, for automatically stripping the excess paper from the stamped sheet, leaving a flexible thin webbing supporting the various rows of stamped forms. The known prior art also contemplates the use of a male and female combination blanking die for automatically separating the planar forms from the flexible web. In short, the male die, effectively through the use of a blanking member, pushes each of the box blanks through the web and supporting female die blanking holes. The thin web typically remains on the face of the female die while the separated blanks are pushed through the blanking holes into a stack below the female blanking die.

For speed and efficiency, the prior art also contemplates the use of a traveling feed bar and grippers to "pull" a sheet through the various stations of the process on a continuous chain drive or other mechanism thereby automatically feeding the sheet from station to station. Similarly, in most applications, the remaining flexible web on the face of the female die after blanking is also pulled away through the use of the traveling bar and grippers into a waste container or other receptacle at the end of the machine.

A problem not yet solved by the prior art, however, involves the remaining thin web typically found on the face of the female die after separation of the box blanks through the use of the male blanking member. In particular, if forms in excess of a specified width are blanked, the remaining web is typically extremely flexible and non-supporting. Accordingly, as the web is pulled from the female blanking die face through the use of the grippers and traveling bar, the inner web portion has a tendency to sag down and become entangled or severed by the edges of the female blanking die. This can cause the automatic blanking operation and feeding of sheets to become inefficient and prone to jamming and breakdown. Accordingly, automatic blanking is limited in the prior art to blanks of less than a predetermined width and with a certain web support strength, in turn limiting the size of die cut paper forms that can be cut on a single sheet which can be produced if the more efficient blanking operation is to be used to separate the die cut blanks from the web.

The present invention solves the problem of blanking forms of significant width through the use of strategically and flexibly placed outfeed lifter ramps which, in effect, serve to internally support the thin web produced after blanking is complete while permitting the sheet, prior to blanking, to be placed firmly on the female cutting die for separation.

Accordingly, the present invention contemplates use of automatic blanking, and the concomitant savings in labor and time, with sheets of die cut forms of practically any width and configuration.

DISCLOSURE OF THE INVENTION

With parenthetical reference to the various drawing figures, the present invention generally comprises an outfeed lift ramp (e.g., 24) for use with a system or press (e.g., 10) for scoring, stamping, stripping and separating paper or cardboard forms from substantially planar sheets.

In general, the system or press comprises a series of blank, planar sheets (e.g., 11) fed into the press or system by the use of a traveling bar (e.g., 22) and appended pulling grippers (e.g., 23) and then to a scoring and/or cutting station (e.g., 12). Thereafter, at the scoring or stamping station, a plurality of rows and columns of die cut forms are, in effect, stamped or scored on to the sheet, although the sheet remains in one piece (e.g., 17) and is next pulled automatically to a stripping station (e.g., 13) where much of the small pieces of excess paper around the die cut forms is automatically removed. What remains is a series of stamped and creased die cut forms held together by a thin web (e.g., 20) therebetween. The thin web and attached die cut blanks are then automatically pulled into a blanking station (e.g., 14) where the die cut blanks are completely separated from the web and are dropped onto a pallet (e.g., 15) for transfer.

The blanking station specifically includes the use of a male/female blanking die combination (e.g., 18, 19) which, when engaged, presses and separates the box blanks from the web and onto the pallet. The remaining thin web lies on the face of the female die component and is ready for disposal in a disposal area (e.g., 16) at the end of the system. As a result of the blanking operation, a planar box blank (e.g., 21) is produced and is in a condition for assembly, by automatic folding or otherwise, and for the insertion of merchandise, food stuffs or other products to be contained therein.

Typically, with forms of substantial width, the remaining web (e.g., 20) and inner web portion (e.g., 25) thereof has a tendency to become caught or torn on the leading edges (e.g., 33) of the female blanking die upon attempted removal of the web through the use of the traveling bar (e.g., 22) and appended grippers (e.g., 23) used to urge the sheet through the entire process. Accordingly, on account of the flexible and non-supportive nature of the resulting web, it is extremely difficult and nearly impossible to blank forms of extended width.

To solve this problem, the present invention includes an outfeed lift ramp (e.g., 24) appended to the female blanking die and extending thereabove along the leading edges (e.g., 33). The lift ramp is specifically positioned and arranged along the leading edge to contact and support the inner web portion (e.g., 25) and to lift it over the blanking die edge as the web is pulled across the die for disposal. The outfeed lift ramp works in conjunction with side support runners (e.g., 26) interposed along the intermediate and edge portions of the female blanking die face to provide lateral support (at the outside edges) to the web in the running direction. So as not to interfere with the blanking operation, and to permit the sheet to be blanked to lie flush against the female blanking die face, the outfeed lift ramps are specifically positioned to extend through existing slots (e.g., 31) or in areas of the die cut blank which, as a result of the stripping operation are present at the time of blanking or, alternatively, that are interposed in the blank for the specific purpose of permitting the use of the outfeed lift ramps as part of the blanking operation.

As a result, the web portion is sufficiently supported throughout its intermediate area and accordingly, the blanking operation may be used with sheets of blanks almost unlimited in width and inherent flexibility.

Accordingly, one of the objects of the present invention is to provide an apparatus and method for use in the blanking stage of a planar die cutting machine or process.

Still another object of the invention is to provide a means for supporting a blanked sheet or web as it is automatically urged through the system through the use of an outfeed lift ramp in combination with a traveling bar and grippers.

Yet another object of the invention is to provide a means to prevent the remaining web attendant to blanking from becoming enmeshed, caught, or otherwise cut on the edge of a female blanking die.

Still another object of the invention is to provide intermediate support means such that stamped sheets of boxes or forms of extended width may nonetheless be automatically blanked thereby saving significant labor hours and cost in stripping off the scrap manually.

These and other objects and advantages of the invention will become apparent from the on-going specification, the drawing figures and the following claims.

DESCRIPTION OF THE DRAWING FIGURES

FIG. 5 is a top plan view of a web remaining after the blanking operation.

FIG. 6 is a top plan view of a planar box or form after stripping and blanking.

FIG. 7 is a perspective view of an outfeed lift ramp.

FIG. 8 is a transverse sectional view of the female blanking die showing the appended outfeed lift ramp taken along 8—8 of FIG. 3.

MODE(S) OF CARRYING OUT THE INVENTION

Figure 1:
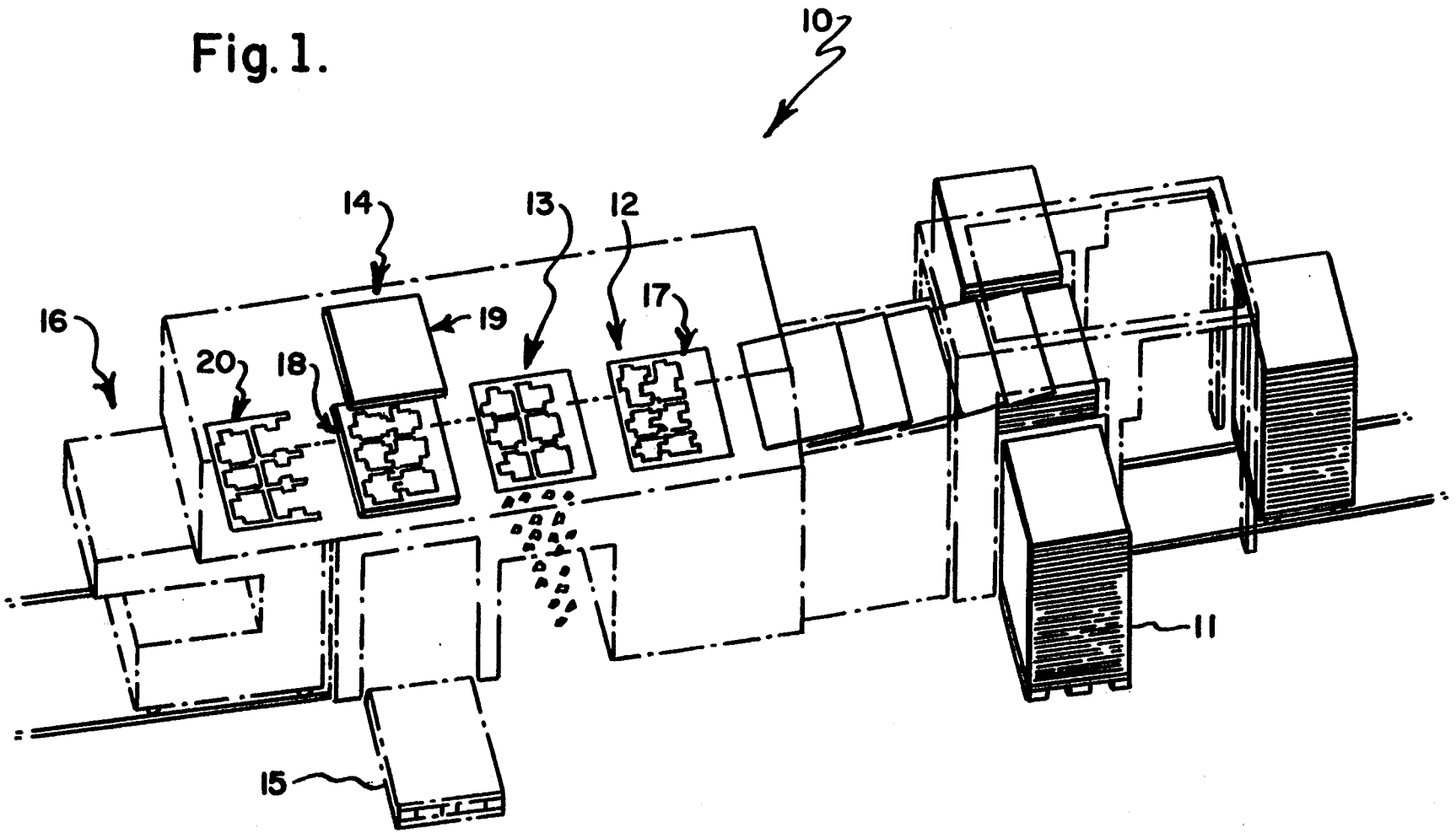
FIG. 1 is perspective view of a typical die cutting process, including a blanking operation.

At the outset, it should be clearly understood that like reference numerals are intended to identify the same structural elements, portions or surfaces consistently throughout the several drawings figures, as such elements, portions or surfaces may be further described or explained by the entire written specification, of which this detailed description is an integral part. Unless otherwise indicated, the drawings are intended to be read (e.g., cross-hatching, arrangement of parts, proportion, degree, etc.) together with the specification, and are to be considered a portion of the entire written description of this invention. As used in the following description, the terms "horizontal", "vertical", "left", "right", "up" and "down", as well as adjectival and adverbial derivatives thereof (e.g., "horizontally", "rightwardly", "upwardly", etc.), simply refer to the orientation of the illustrated structure as the particular drawing figure faces the reader. Similarly, the terms "inwardly" and "outwardly" generally refer to the orientation of a surface relative to its axis of elongation, or axis of rotation, as appropriate.

The present invention generally comprises an outfeed lift ramp, 24, for use with the blanking operation portion, 14, of a die cutting press or process, 10. The blanking operation specifically includes a female blanking die portion 18 and a complementary male blanking die 19 for blanking or separating die cut box blanks or other forms into a detached web 20 and a substantially planar and unassembled die cut blank 21. The die cut sheet 17 is automatically pulled through the press operations, and over the female die portion, through the use of a traveling bar 22 having appended gripper fingers 23 adapted to grip the leading edge 30 of the die cut sheet 17.

After blanking, web 20 remains on the face of the female die portion and includes a series of intermediate web portions 25 which, together, form an extremely flexible and flimsy paper "skeleton" which must be removed from the female blanking die face. In actual operation, the traveling bar 22 and appended grippers 23 pull the flexible web 25 over the female blanking die face, including the female blanking die's leading edges 33.

To avoid snagging, tangling or cutting of the web portions on the female blanking dies leading edges, the female blanking die face includes web support runners 26 primarily in the running direction of the female blanking die to assist in the elevation of the web 25 and the specifically configured and positioned outfeed lift ramps 24 capable of providing intermediate and internal support of the flexible web portion 25. This permits the web portion to be safely dragged over the leading edges of the female blanking die without tangling, cutting or snagging.

Figure 2:
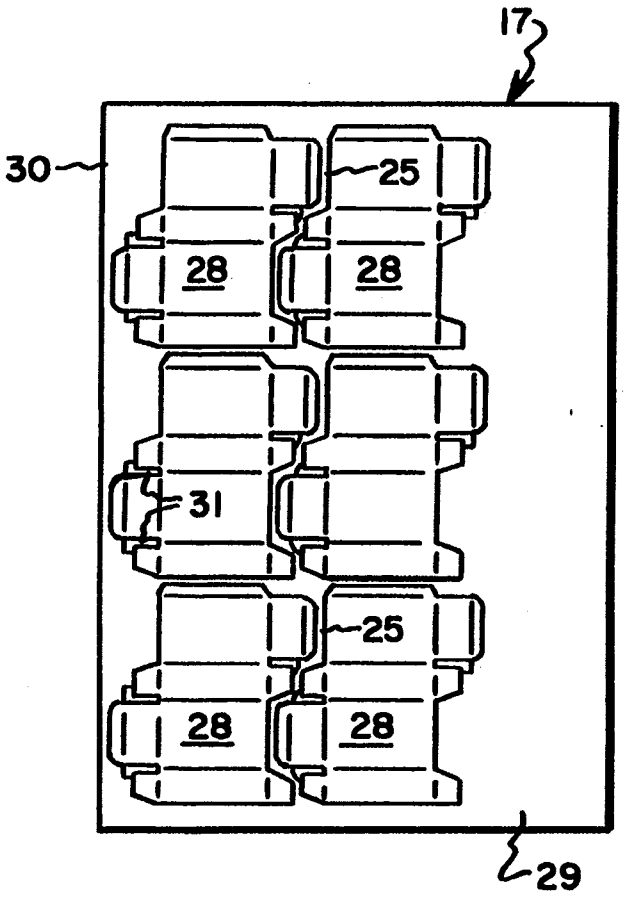
FIG. 2 is a top plan view of a substantially planar sheet with die cut forms stamped for stripping and blanking.
Figures 9, 10, 11, 12, 13:
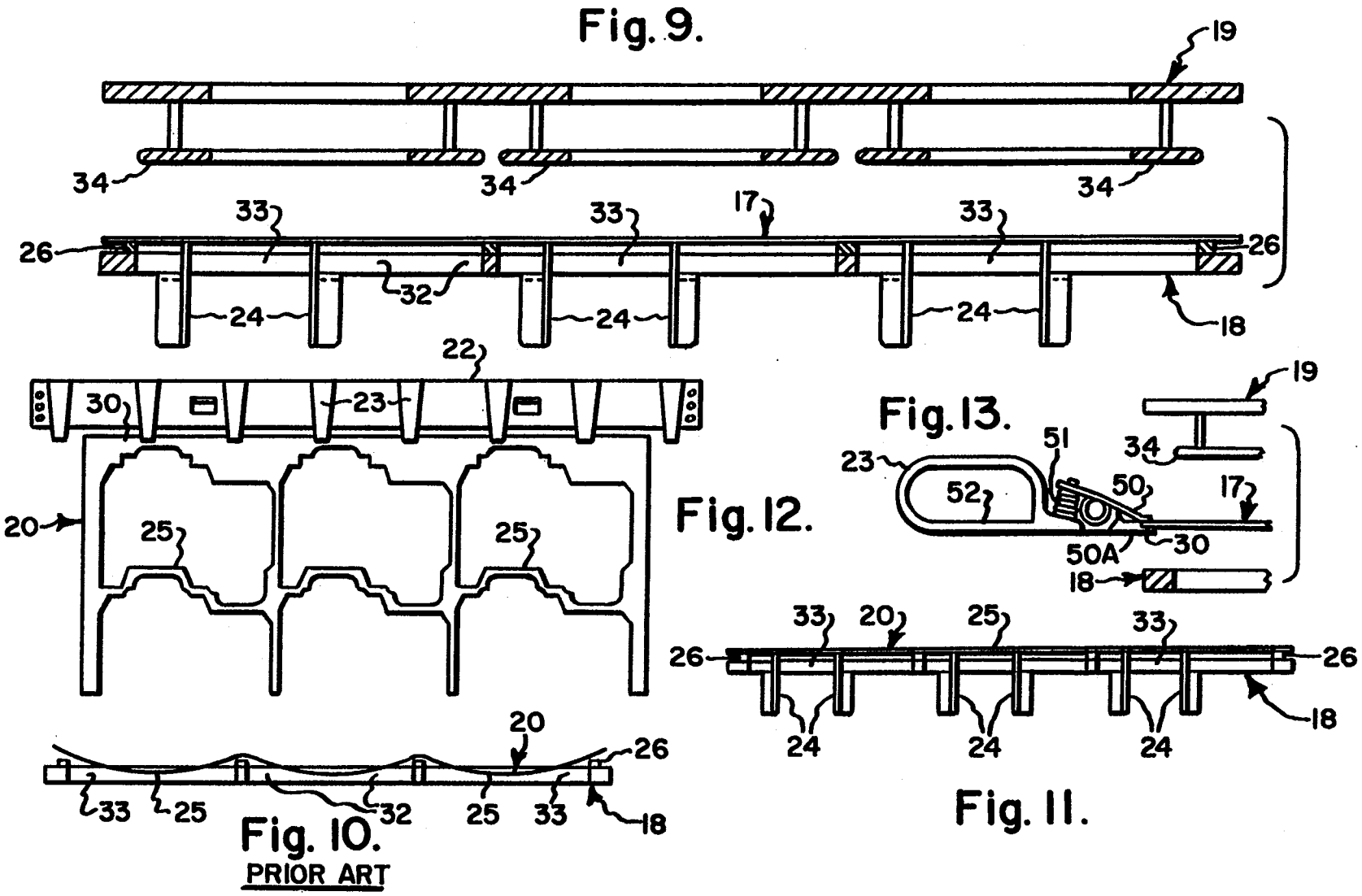
Fig. 10. PRIOR ART
FIG. 9 is a transverse sectional view of both the female and male blank portions showing the blanking members and lift ramps taken along 9—9 of FIGS. 3 and 4.
FIG. 10 is an end elevation of the prior art showing a female die without lift ramps and the inherent interposition of the web portion along the edges thereof.
FIG. 11 is an end elevation of the female die showing the appended outfeed lift ramps and a suspended and supported web.
FIG. 12 is a top plan view of the traveling bar and grippers appended to a web after the blanking operation.
FIG. 13 is a partial transverse sectional view of the male and female blanking die and a side elevation of a gripper appended to a sheet.

Adverting specifically to FIG. 2, stamped sheet 17 is shown to be a substantially planar paper or cardboard sheet of a specific length and width that, in the drawing figure, has been die cut with a layout of two rows of three box blanks each, 28, held together and connected by thin web 25 and unusable sheet scrap portion 29. Sheet 17 is further shown to include a substantially straight leading edge 30 adapted to be gripped, as shown in FIG. 13, by grippers 23 and "pulled" through the process by traveling bar 22.

Importantly, continuing to advert to FIG. 2 and also to FIG. 6, the die cut box blanks or forms are shown to include a series of slots, 31, which may define certain angles or portions of box blank 21 upon separation or, alternatively, are benign and instead, are inserted as part of the box design for purposes of accommodating the outfeed lift ramp in the blanking operation described below.

After die cutting 12, sheet 17 is next urged into stripping station 13 wherein much of the excess and unusable paper or cardboard 29 from sheet 17 is effectively removed or stripped from around the die cut box blanks or forms. Adverting to FIG. 5, what remains after stripping is web portion 20, including straight leading edge 30 and appended inner web portions 25, defining the outlines of the die cut and still appended and connected box blanks 28. Although the drawing figures, e.g., FIGS. 2 and 5, disclose a sheet stamped with two rows of three boxes each and a resulting web of equal dimension, it is possible to have sheets of multiple rows and columns, depending upon the design of the form and length and width of the chosen sheet.

Continuing to advert to FIGS. 2 and 5, after blanking and separation of the die cut blanks from the webbing, the remaining port/on, including inner web 25, is extremely flexible and non-supportive and, depending upon its overall width, is liable to droop or lose its substantially planar orientation. Accordingly, if suspended or moved over an opening, such as a die through hole, inner web portion 25 may be susceptible to catching, entanglement or snagging on the edges of the female blanking die, 33, as described below. This, of course, will undoubtedly cause the automatic press operation to be obstructed or slowed.

Adverting again to FIG. 1, after the stripping operation, the remaining portion of the sheet, with suspended die cut blanks, is urged to the blanking operation, 14, of the process. The blanking operation serves to separate the actual blanks from the suspending web portion using the male, female die combination best illustrated in FIGS. 3 and 4.

Figure 3:
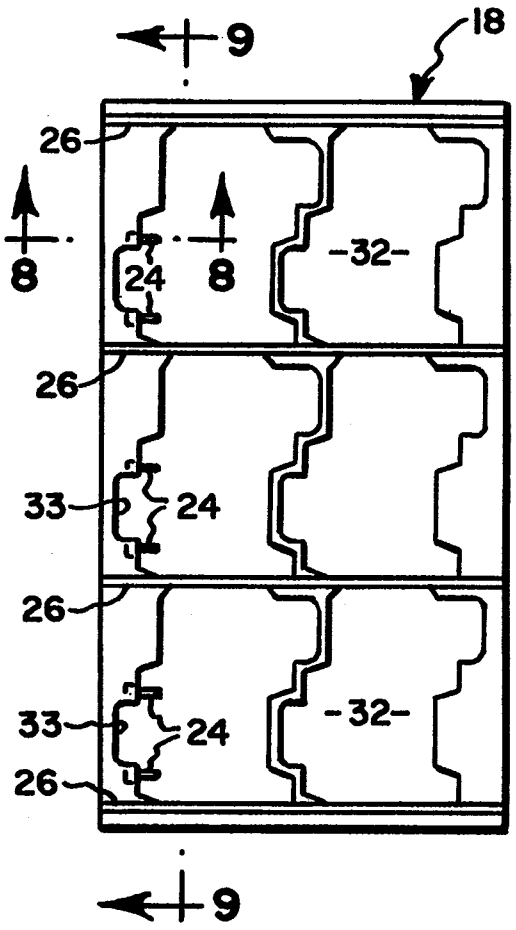
FIG. 3 is a top plan view of a female blanking die with attendant blanking holes.

In particular, FIG. 3 shows the female blanking die, 18, as being a substantially rectangular member having, extending through its planar surface, a series of blanking holes, 32, matching the profile of the die cut layout of blanks, 28, shown, for example, in sheet 17 of FIG. 2. The female blanking die further includes, attendant to each blanking hole, a leading edge 33 used, in part, with the other edges of the holes, to assist in the separating or cutting of the box blanks from the webbing. The female die surface is further shown to include a series of parallel support runners 26 extending above the surface of the female blanking die in the running direction, as well as intermittently when possible, depending upon the layout of the box blanks. As shown in FIGS. 9 and 11, the runners are substantially rectangular elongated members that, in effect, provide support for sheet 17 or web 20 as it crosses the face of the female die along the direction of the process.

Figure 4:
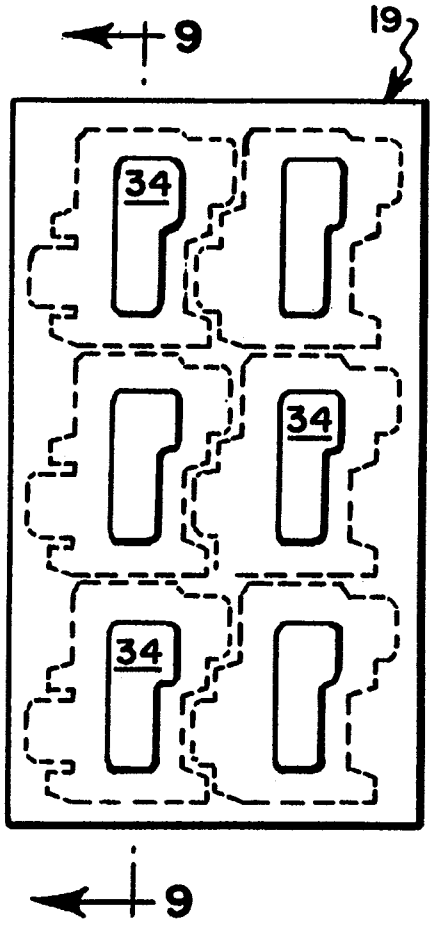
FIG. 4 is a top plan view of a male blanking die with attendant blanking members.

Adverting now to FIG. 4, complementary male die 19 is shown to be a substantially rectangular member, similar to female die portion 18, and is shown to further include a series of blanking members 34 operatively arranged along the surface of the male die and shaped to be coincident with the blanking holes, 32, of female die 18. Blanking members 34, however, although of substantially identical shape to holes 32 and suspended box blanks 28, are necessarily somewhat smaller in dimension to permit the blanking members to push and separate suspended box blanks 28 from resulting web 20 by the pressing together of the male and female dies.

Adverting to FIG. 9, the male and female die portions are shown in section and with stamped sheet 17 interposed over the female die and supported by lateral support runners 26 and outfeed lift ramps 24. More specifically, FIG. 9 illustrates, in general, the operation of the blanking dies; i.e., male die 19 is pressed downward through the corresponding female die through holes, thereby separating and pushing through the through holes resulting die cut blanks 21, as shown in FIG. 6, and leaving web 20, as shown in FIG. 5, on the surface of the female die. At this point, it is then necessary to automatically remove from the female die face the remaining web portion 20 by use of the traveling bar and grippers.

Adverting now to FIG. 10, the problem in the prior art is best illustrated. Specifically, resulting web 20 and its especially weak inner web portions 25 are shown to be non-supportive and to drop within blanking through holes 32. Web 25 is therefore prone to snagging on female die leading edge 33, notwithstanding the presence of lateral support runners 26. Accordingly, use of the automatic blanking operation and removal of remaining web 20 by the traveling bar and grippers would likely be inefficient and prone to problems attendant to snagging and jamming of the system.

FIG. 11 generally illustrates the use of the present invention, the outfeed lift ramp, 24, to solve the problem and to lend internal support to the highly flexible and non-supportive web portion 25, thereby permitting the remaining web 20 to be easily lifted and removed from the female die face without the opportunity for snagging or tangling.

Adverting to FIGS. 7 and 8, the outfeed lift ramp 24 is shown in detail and its affixation to female die portion 18 is similarly illustrated. In particular, adverting first to FIG. 7, outfeed lift ramp 24 is shown to be a specially configured integrally formed member having a ramp portion, 35, defined by a substantially vertically downwardly extending arcuate edge portion 38, a substantially horizontally extending bottom edge portion 39, and an upwardly vertically extending left edge portion 40 resulting in the formation of the ramp-like angled portion 35. Flange-like fastener portion 36 of the lift ramp is shown to include a substantially vertical right edge portion 41, which joins complementary vertical edge portion 40, thereby connecting the fastener and ramp portions of the lift ramp. The fastener portion further includes a substantially horizontal bottom edge 46 and a vertically upwardly extending left edge portion 45. Flange portion 37 is formed by the intersection of right horizontal edge portion 42, leading horizontal edge portion 43 and left horizontal edge portion 44. The top surface 49, formed by the intersection of these edges is shown to include one or two screw holes, 48, to facilitate fastening of the outfeed ramp to leading edge of the female blanking die 33.

Continuing to advert to FIG. 8 and also to FIGS. 9 and 11, the outfeed lift ramp is shown to be appended to the under-side of female blanking die leading edge 33 through the use of screws, 47, interposed through screw holes, 48, on the fastening surface 49 of the lift ramp. As specifically shown in FIG. 8, when fastened to leading edge 33, the top arcuate portion 38 of the lift ramp extends above the die top surface and leading edge 33 and is capable of lifting web 20 or, in particular, internal web 25 across the top of female blanking die leading edge 33 as well as internal web of the female blank to prevent tangling. Further, the arcuate edge 38 thereof is angled inward toward the die face and is therefore adapted to lift the web at a steady and convenient rate off the die face.

Importantly, as is illustrated in FIGS. 2, 3 and 6, outfeed lift ramps 24 are spaced along the leading edge 33 of the female die at positions corresponding to the location of slots 31 of the die cut blanks or stripped out areas as suspended in sheet 17 after stripping. Accordingly, while the lift ramps are adapted to support the resulting web after blanking as the web is pulled across the die face and in particular, leading edge 33, the lift ramps are also strategically positioned such that as the stamped sheet is urged across the female die into the blanking position, the sheet is able to lie flat on the die surface while the lift ramps project through the sheet and box slots 31. Accordingly, the presence of the lift ramps does not interfere with the blanking operation or box blank as it rests on the die face; rather, the lift ramp only serves to support the internal web portion remaining after blanking as it is pulled across the die edge.

Adverting now to FIG. 12 and 13, traveling bar 22, which continuously urges sheet 17 or web 20 through the process, is shown to be a transversely (i.e., relative to the sheet) oriented member typically mounted on a chain drive (not shown) along the extent of the process stations. The traveling bar serves to guide the sheets through the process automatically without the need for intervention of labor of an operator. Connected to the bar at various points along its length are a series of grippers, 23, adapted to grip the edge, 30, of the sheet or web for "pulling" through the process. Adverting in particular to FIG. 13, gripper 23 is shown to be comprised of an attachment portion 52 adapted to be connected to bar 22, a pair of pincers 50, 50A which are forced together by appended spring 51 and adapted to tightly grip the end of the sheet edge 30. Gripper 23 and attendant bar 22 serve to guide the sheet through the entire process from start to finish. This includes the removal of web portion 20 from the female blanking die face after completion of the blanking operation.

In operation, a blank sheet 11 is fed into the process and is gripped at its leading edge by gripper 23 and bar 22. The sheet is then "pulled" through the process, first to the die cutting operation 12. During the die cutting operation, an array of blanks is etched or stamped onto the sheet for later separation, and the die cut sheet is then pulled to the stripping station 13. At the stripping station, much of the excess and surplus paper on the stamped sheet is removed, yet the die cut blanks are held together by a thin well 20. The stripping operation also includes exposure of various blank slots 31 in anticipation of the blanking operation to follow. After stripping, the web and suspended blanks are next pulled to the blanking station, 14, for separation into unattached box blanks 21 and web portion 20 for disposal. In particular, the stripped sheet is urged over female blanking die portion 18 and through holes 32. The sheet lies flush against the female blanking die surface, and the outfeed lift ramps 24 (i.e., the extending top arcuate portion thereof 38) protrudes through blank slots 31. Male die 19 and attendant die members 34 are pressed against the female die and the blanks are forced through the female cutting die through holes and separated from the web 20. Upon completion of the blanking operation, blank 21 has been pushed through the female blanking die through holes 32 into a pallet or stack, 15, therebelow. The remaining web 20 is, at its leading edge 30, still held by grippers 23 and bar 22. On account of the blanking operation, internal thin webs 25 remain on the female blanking die surface and must be lifted above female blanking die leading edges 33 in order to be completely removed from the die surface without snagging or entanglement.

As web 20 is pulled across the face of female blanking die member 18, inwardly angled and facing lift ramps 24, working in conjunction with side lift runners 26, serve to continuously lift the extremely flexible inner webs, 25, above female blanking die surface 33 without snagging or entanglement. Accordingly, lift ramps 24, while permitting the flush engagement of the sheet to be blanked against the female blanking die face through the use of slots 31, nonetheless serves to support the flexible inner web portion 25 as it is dragged and urged across the leading edge 33 of the female blanking die.

Thus, regardless of the non-supportive nature of certain blanks of widths and webbing, the outfeed lift ramps permit blanking, while supporting the resulting flexible internal webs and precluding snagging or entanglement. Moreover, on account of the positioning of the lift webs, and the attendant slots, 31, whether integrally part of the box design or placed in benign sections of the box or any specially added portions of the sheet, the blanking operation is in no way impeded since the sheet lies flush against the female blanking die surface while the sheet is blanked.

Accordingly, outfeed lift ramps 24 achieve the desirable effect of permitting blanking of sheets of various widths that are non-supportive in nature and accordingly, solves the primary problem apparent in the prior art efficiently and effectively.

MODIFICATION TO THE INVENTION

The present invention contemplates many modifications and alterations aside from the embodiment disclosed in the drawings and specification.

For example, the design and shape of the outfeed lift ramp, together with its method of attachment, may clearly be modified or changed without departing from the spirit of the invention or from the important function of the ramp; i.e., to lift the non-supporting internal web off the die face without interfering with the underlying blanking operation.

Similarly, the invention and method attendant thereto contemplates the positioning of slots at various portions along the blanks, aside from any natural positions required for assembly of the blank and further, contemplates the addition of extra sheet portions to accommodate the ramps. Therefore, placing of the lift ramps may be flexibly altered to accommodate various box designs, whether having slots or otherwise.

Too, while the described invention is used in connection with a system or press for producing stamped and etched box blanks, the blanking operation may be separately accomplished or employed aside from any existing system.

These and other modifications would necessarily be apparent to one of ordinary skill in the art and accordingly, the invention should not be limited to the specification and drawings herein, but rather, should be read in the context of the scope of the claims and the known skill in the art.

We claim:

1. In a box blanking device having male and female die portions for separating sheets of die-cut blanks of preselected size and shape, the improved female die portion comprising:

a die surface having a planar top, a bottom, a leading edge, and a plurality of side edges;

a plurality of blanking holes interposed through said die surface, said blanking holes conforming to said size and shape of said die cut blanks;

runners interposed on the top of said die surface adapted to laterally support said sheets atop said die planar top surface;

a plurality of lift ramps interposed adjacent to said leading edge of said die, said lift ramps adapted to medially support said sheets and guide said sheets over said leading edge of said die surface and wherein each of said lift ramps is an arcuate member mounted on said die bottom surface and extends above said die top surface;

wherein said female die is adapted so that said sheets can be removed from said female die without impeding said blanking operation.

* * * * *